US005692964A

United States Patent [19]

Smith et al.

[11] Patent Number: 5,692,964

[45] Date of Patent: Dec. 2, 1997

[54] GOLF SWING TRAINING DEVICE

[76] Inventors: Walter H. Smith; Ryan T. Smith, both of 1310 Demerse, Prescott, Ariz. 86301

[21] Appl. No.: 503,477

[22] Filed: Jul. 18, 1995

[51] Int. Cl.[6] ..... A63B 69/36

[52] U.S. Cl. ..... 473/220; 273/DIG. 30

[58] Field of Search ..... 273/186.3, DIG. 30; 473/220

[56] References Cited

U.S. PATENT DOCUMENTS

| | | | |
|---|---|---|---|
| 2,787,470 | 4/1957 | Barrus | 273/186 |
| 3,191,939 | 6/1965 | Hooper | 273/186 |
| 3,753,564 | 8/1973 | Brandell | 273/186 A |
| 3,820,795 | 6/1974 | Taylor | 273/186 A |
| 5,230,512 | 7/1993 | Tattershall | 273/186.3 |
| 5,288,080 | 2/1994 | Tice | 273/186.3 |
| 5,470,072 | 11/1995 | Cunningham | 273/186.3 |

FOREIGN PATENT DOCUMENTS

| | | | |
|---|---|---|---|
| 2039749 | 8/1980 | United Kingdom | 473/220 |

*Primary Examiner*—George J. Marlo

[57] ABSTRACT

This device attaches to the head of an existing golf club (16) and contains two bright Light Emitting Diodes (LEDs) (11 and 26) to show the path of the club head during practice swings. The LEDs are of different color and are oriented on a line parallel to the direction of swing. This allows the golfer to also see whether the club head was twisted during the swing, and if so, to see the direction of twist. Each LED is independently switched and controlled for brightness by its own potentiometer (12 and 27). A battery (17) is contained within the device. The device is attached to a golf club by an EPDM sleeve (15) which pulls onto the club head and by hook and loop material (19) on both the sleeve and the device. A safety loop (14) would keep the device from flying off the club head if it was incorrectly attached.

3 Claims, 2 Drawing Sheets

GOLF SWING TRAINING DEVICE

BACKGROUND

1. Field of the Invention

This invention relates to golf swing training devices, specifically and exclusively to a device which attaches to the head of an existing golf club and contains lights which show the path of the club head during a swing.

2. Description of Prior Art

Many inventions have had the goal of allowing a golfer to see the actual path of the golf club head during practice swings. Some have also been able to show whether the face of the club was perpendicular to the direction of the swing or twisted. Both of these factors are very important to good golf swings because they determine the path of the golf ball to a great extent.

Various methods have been used to accomplish the above goals, including mechanical dispensing of marking material on the ground during swings, the combination of luminescent material on the club head and ultraviolet light for viewing it, mirrors on the club head, and battery powered lights attached to the club head or shaft. The methods using battery powered lights seem to be potentially the most practical and effective.

Among the methods which have used battery powered lights to show the path of the golf club during a swing, a broad division of catagories can be made by separating devices which attach to existing golf clubs from those that are incorporated into specially made or modified practice clubs. It is advantageous for a golfer to use a device which attaches to his own clubs for practice swings and diagnosing problems. Besides saving him money, he will be using familiar clubs with the correct shaft lengths.

Further distinctions can be made by whether the devices show only the path of the club head during a swing or are also capable of showing club head twist; whether the lights shine down toward the ground or shine up toward the golfer's eyes; and also whether the batteries are mounted on the golf club head or are mounted elsewhere.

The following three inventions use lights that shine down toward the ground. This limits their usefulness because only the lowest portion of the swing arc can be seen:

U.S. Pat. No. 3,070,373 (Mathews) uses a single light mounted on the shaft of a golf club with a separate battery connected to the light by a wire. This device is not capable of showing club head twist.

U.S. Pat. No. 4,342,465 (Miyamae) is a specially made putter with two lights in it pointing down toward a mat containing sensors.

U.S. Pat. No. 4,858,934 (Ladick) is a simulated golf club containing only a grip and part of a shaft with a light that points down and shines on a special sensing mat.

The following three inventions contain single light sources which point up and are visible to the golfer through most of the swing. All three show the path of the club but none are capable of showing club head twist:

U.S. Pat. No. 3,820,795 (Taylor) is a light which clamps onto the shaft of a golf club and has a self contained battery.

U.S. Pat. No. 4,108,441 (Treadway) is very similar in layout to Taylor's invention above.

U.S. Pat. No. 5,230,512 (Tattershall) is a device which attaches to a golf club head and has a self contained battery. It also has an optional second light source which would be visible to a coach but still would be of no value in showing club twist.

The following five inventions use more than one light to show both the path of the golf club head and whether it was twisted during the swing. All seem to accomplish these goals but either require a separate and specially made practice golf club or are attached to a regular golf club in a relatively awkward manner, with a battery which is remote from the device itself and is connected to the light source by wires. This limitation may have been a result of technology which required larger batteries than are required by today's light sources. Also, none of the five have brightness adjustments, so their usefulness is limited:

U.S. Pat. No. 2,787,470 (Barrus) is a device which is attached to a golf club head by a screw and a clamp and is connected by wires to the battery compartment. The battery compartment is clamped to the shaft of the club just below the grip. The device has three colored lights arranged in a triangle and uses differences in their apparent relationship to each other to detect club head twist during a swing. The arrangement of the three lights makes the device more cumbersome and also more complicated to use than the present invention. Barrus' device is almost identical to a portion of an earlier U.S. Pat. No. 2,158,211 (Aitken). It is very bulky compared to the present invention due to its separate battery compartment, mounting clamps and the size of the unit itself.

U.S. Pat. No. 3,191,939 (Hooper) is a device which is clamped to a golf club head and consists of a boom with a light at each end. The same principle as in the above patent is used to show club head twist during a swing but the device is even bulkier and its battery pack is worn on the belt and is connected by wire. Also, the device fails to take advantage of different color light sources to show the direction of any twist in the club head during a swing.

U.S. Pat. No. 3,753,564 (Brandell) is a specially made practice club which contains two lights of different color in its head and uses the same principle as the above two inventions to show club head twist. The trailing light is adjustable and enables the club to be used to practice different swing paths and club head twists. The shaft is shorter than a regular golf club's.

U.S. Pat. No. 5,288,080 (Tice) is a specially modified practice club which contains a row of five Light Emitting Diodes arranged parallel to the club face. Normally this arrangement would not show club head twist during a swing, but this invention contains a strobing device in the head of the club which does make it possible to see club head twist.

Summary of the Invention

This invention allows a golfer to see the actual path of the club head during practice swings and also to see whether the face of the club head is square to the path of travel, twisted toward the "open" position, or twisted toward the "closed" position. This is all accomplished by the use of a small device that attaches directly to the head of the golfer's own club. It contains two bright Light Emitting Diodes (LEDs) of different color which are oriented parallel to the direction of swing. As the golfer swings at a reference stripe on a mat, the LEDs are seen as one or two light streaks, depending on the amount of twist of the club head.

Furthermore, the direction of any twist can be easily seen by the orientation of the colored streaks. If the outermost streak is the color of the leading LED, the club head was twisted toward the "open" position, which would have resulted in a probable "slice", and vice versa for a probable "hook". The probable location of the ball's impact on the club face is seen by comparing the path of the light streak to the stripe on the mat. This also shows whether the swing path was "outside-in", "inside-out" or straight. In addition to the golfer's ability to see these details of his swing using this device, a coach or instructor can also see them. The brightness of the LEDs is adjustable, allowing the device to be used during the day or at night, indoors or out. The importance of this feature may not be realized before an invention is reduced to practice, but will be seen after actual use in dim light.

The three swing defects mentioned above are: twisting the club head, striking the ball off center with the club face, and not keeping the club head on line during the swing. All three are very common but distinctly different defects. Each is caused by different mistakes made by golfers during their swings and each must be corrected by different methods. However, since each type swing defect can lead to the same results, i.e. "hooks and slices", it is very difficult to tell by hitting golf balls which swing defect is causing poor results. Herein lies the diagnostic value of this invention.

This invention differs from prior art by its:

(1) use of a battery contained within the body of the device
(2) use of dimmer switches to allow both indoor and outdoor use, during the day or at night
(3) compact size and ease of attachment to the golfer's own clubs
(4) simplicity and ease of manufacture Some of the prior art referenced incorporates some of these traits but the subject invention possesses all of them.

Objects and Advantages

None of the prior art referenced contains all of the following objects and advantages. The objects and advantages of the present invention are to provide a golf swing training device which:

1. shows the path of the club head during practice swings;
2. shows whether the face of the club head is perpendicular to the path of travel, twisted clockwise, or twisted counterclockwise during practice swings;
3. shows the probable location of a golf ball's contact with the face of a club head during practice swings;
4. is easily attachable to a golfer's own clubs;
5. can be used during the day or at night, indoors or outside;
6. is compact and light enough to allow normal swings; and
7. is simple enough to be easily manufactured and economical for golfers to buy.

REFERENCE NUMERALS IN DRAWINGS

Figure 1:
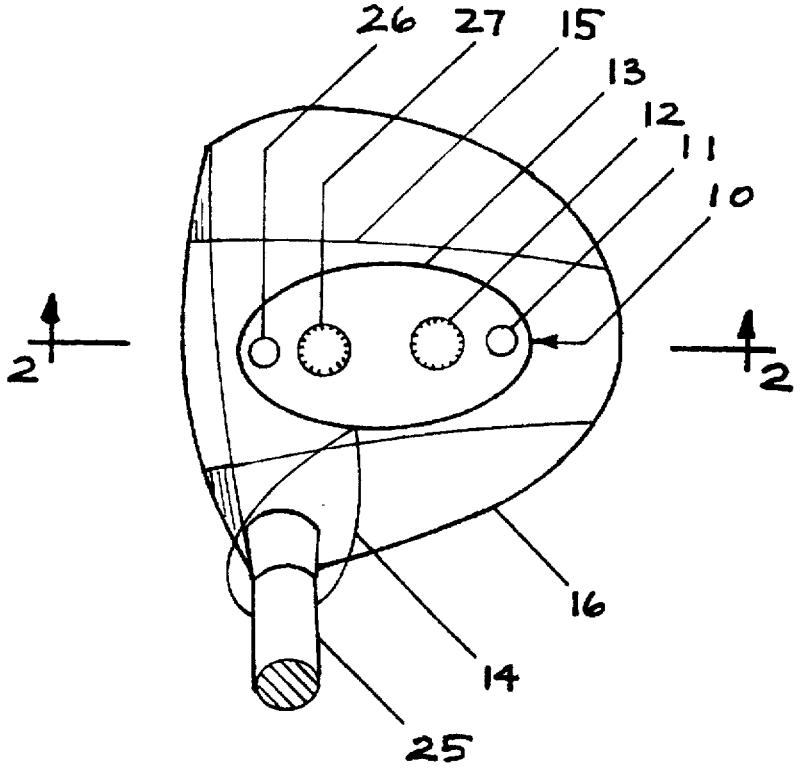
FIG. 1 shows a plan view of the device installed on a regular golf club.
Figure 2:
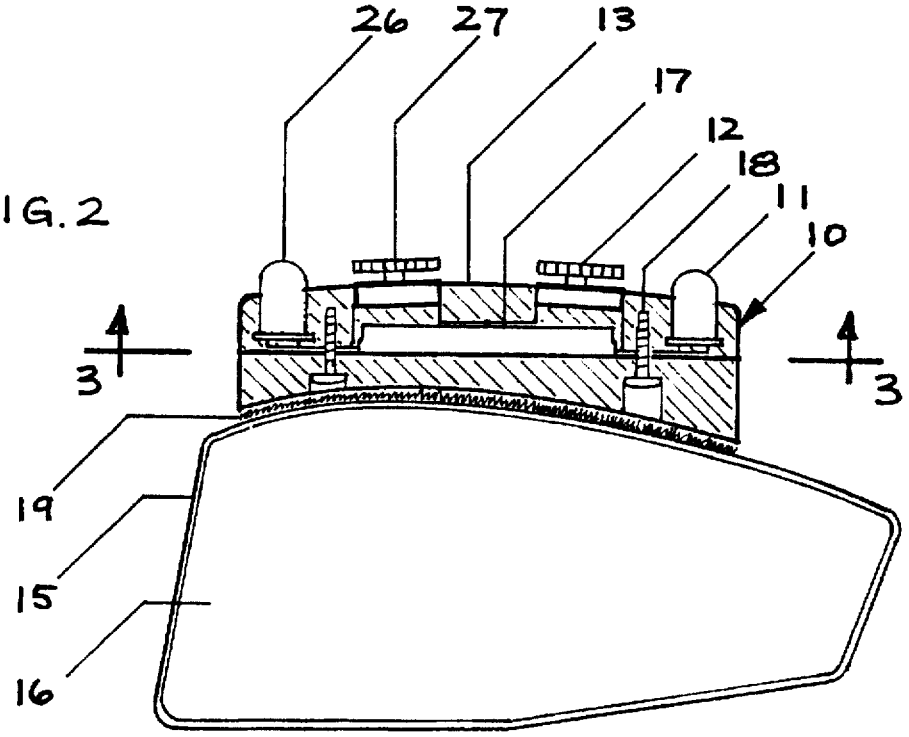
FIG. 2 is a sectional view taken along line 2—2 of FIG. 1.

| | |
|---|---|
| 10 golf swing training device | 19 hook and loop material |
| 11 trailing LED | 20 resistor |

-continued

REFERENCE NUMERALS IN DRAWINGS

| | |
|---|---|
| 12 trailing potentiometer | 21 mat |
| 13 body of device | 22 stripe on mat |
| 14 safety loop | 23 white circle on mat |
| 15 EPDM sleeve | 24 colored streak |
| 16 golf club head | 25 golf club shaft |
| 17 battery | 26 leading LED |
| 18 screw | 27 leading potentiometer |

DETAILED DESCRIPTION OF INVENTION

This invention consists of a golf swing training device 10 and the method used to attach the device to the user's own golf club head. A mat 21 used for practice swings is an obvious accessory and is not part of this specification except for clarity in showing function.

The body of the device 13 is split horizontally into two sections which are held together by two screws 18. Removing the screws allows access to a coin type battery 17. A pair of LEDs is provided, comprising a leading LED 26 and a trailing LED 11. A pair of potentiometers is provided to serve as switches and brightness controls for the LEDs. A leading potentiometer 27 controls the leading LED 26 and a trailing potentiometer 12 controls the trailing LED 11.

Figure 3:
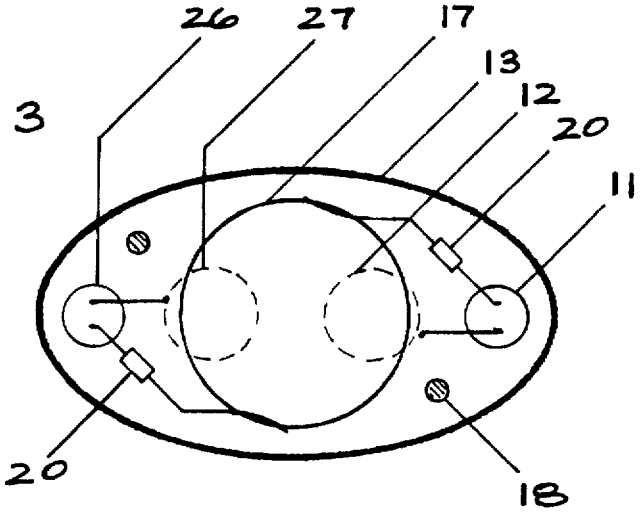
FIG. 3 is a sectional view taken along line 3—3 of FIG. 2, looking up at the top section of the device.

Separate potentiometers of different resistance values are required to maintain equal brightness of the LEDs in varying light conditions. Different colored LEDs have different forward voltages and therefore dim at different rates if the same resistance value is used in each potentiometer, or if the same potentiometer is used for both LEDs. Even though different value resistors 20 (FIG. 3) are used to protect the LEDs from excess voltage, it is still necessary to use separate potentiometers, each of a different resistance value, to achieve equal brightness. This is because the ratio between battery voltage and fixed protective resistance changes as the voltage drops due to battery use.

A safety loop 14 is attached to the body of the device 13. It slips over a golf club shaft 25 and would keep the device from flying off if it were improperly installed. Hook and loop material 19 is glued to the bottom of the body and to the top of an EPDM sleeve 15 and serves to attach the body to the sleeve.

The EPDM sleeve 15 is made of Ethelene Propylene Diene Modified or some other type of elastic material, and is pulled onto a golf club head 16. It is sized to give a tight and secure fit on larger wooden club heads and most of the oversize metal clubs available. Sleeves of other sizes can be made available.

The mat 21 functions to provide a stripe 22 to compare with the swing path of the club head. This swing path shows as a colored streak of light, as will be explained. A white circle 23 on the mat simulates a golf ball for practice purposes. The mat also serves as floor protection when used indoors and to protect the club head when used on concrete or similar surfaces.

Operation of Invention

In order to attach the golf swing training device 10 to the user's club, the EPDM (or other elastic material) sleeve 15 is first pulled onto the club head 16, with the sleeve oriented so that its hook and loop material 19 faces up. After placing the safety loop 14 over the golf club shaft 25, the plastic body of the golf swing training device then attaches to the club head by the use of hook and loop material 19. It is attached so that the two Light Emitting Diodes (LEDs) are oriented along a line which is perpendicular to the face of the club and parallel to the direction of swing.

In order to use the golf swing training device the golfer places the mat 21 on the floor or ground with the stripe 22 oriented parallel to the direction of swing. The LEDs are then turned on and adjusted for brightness by turning the knobs of the potentiometers. The golfer then takes up his stance in the usual manner, addresses the white circle 23 on the mat as if it were a golf ball, and swings in the usual manner.

During the swing, the movement of the LEDs causes colored streaks 24 (FIG. 4) to be seen by the golfer. These streaks indicate the exact path of the club head, and the amount and direction of twist, if any, of the club head. This information allows the golfer, and a coach, to analyze the path of the club head and serves as a valuable method to improve the golfer's swing.

Figure 4:
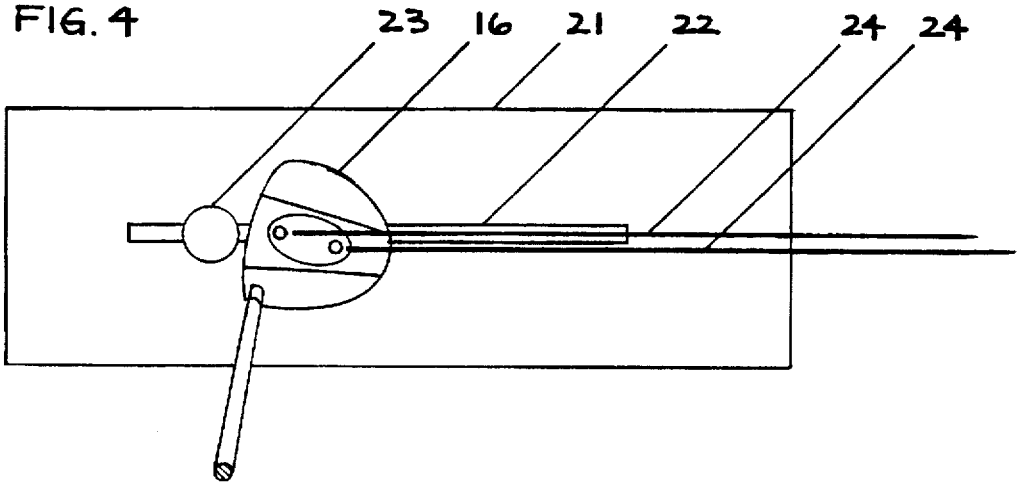
FIG. 4 shows a plan view of a golf swing with the club path on line but with the club head twisted clockwise, or "open".
Figure 5:
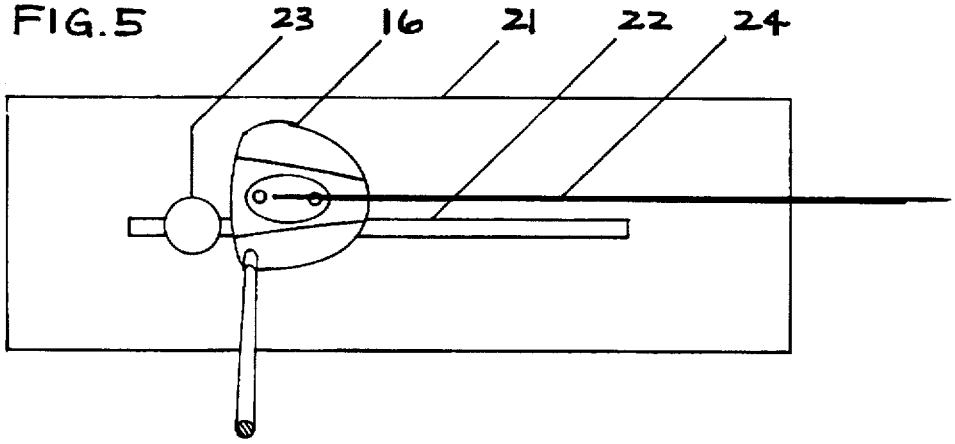
FIG. 5 shows a plan view of a golf swing with the club head square to the club path but with the club path off line.

If the path of the club head did not follow the stripe on the practice mat, as in FIG. 5, corrections can be made to the appropriate aspects of the golfer's swing. If two streaks are seen, as in FIG. 4, twisting of the club head is indicated. The direction of twist is easily determined by the position of the differently colored streaks. An "opening" of the club head during the swing will cause the leading LED to make a colored streak farthest from the golfer and the trailing LED to make a differently colored streak closest to the golfer (FIG. 4). The opposite will be observed for a "closing" twist of the club head. The amount of space between streaks indicates the severity of the club head twist.

We claim:

1. Golf swing training apparatus comprising in combination:

a. a body adapted to be attached to the head of a golf club;

b. at least two light sources disposed on the body, including (1) at least two different colors, and (2) adapted to be oriented on a line parallel to the direction of swing and perpendicular to the face of said golf club's head; and c. means for switching and adjusting the brightness of each said light source independently; and d. an electric circuit including a battery disposed in the body as a source of power for the light sources, whereby a user of the apparatus receives a visual indication of the user's swing by the alignment of the light sources while swinging.

2. Golf swing training apparatus comprising in combination:

a. a body adapted to be attached to the head of a golf club , including (1) an elastic sleeve to be pulled onto the head of said golf club, and (2) hook and loop fastener material attached to both said elastic sleeve and to said body for securing the body to the golf club head;

b. at least two light sources adapted to be disposed on the body, including (1) at least two different colors, and (2) adapted to be oriented on a line parallel to the direction of swing and perpendicular to the face of said golf club's head; and c. an electric circuit including a battery disposed in the body as a source of power for the light sources, whereby a user of the apparatus receives a visual indication of the user's swing by the alignment of the light sources while swinging.

3. Golf swing training apparatus for a golf club head comprising in combination:

a. a body adapted to be attached to the head of an existing golf club, including (1) an elastic sleeve to be pulled onto the head of said golf club, and (2) hook and loop fastener material attached to both said elastic sleeve and to said body for securing the body to the golf club head;

b. at least two light sources of different colors secured to the body and spaced apart from each other and adapted to be oriented on a line parallel to the direction of swing and perpendicular to the face of said golf club; and c. means for switching each light source and for adjusting the brightness of each light source independently; and d. an electric circuit including a battery in the body for providing a source of power for the light sources, whereby the apparatus provides a visual indication of the user's swing by the alignment of the light sources during the swing.

* * * * *